US005133652A

United States Patent [19]

Abe et al.

[11] Patent Number: 5,133,652

[45] Date of Patent: Jul. 28, 1992

[54] ROTARY COMPRESSOR HAVING AN ALUMINUM BODY CAST AROUND A SINTERED LINER

[75] Inventors: Yoshikazu Abe, Neyagawa; Tatuhisa Taguchi, Katano, both of Japan

[73] Assignee: Matsushita Electric Industrial Co., Ltd., Osaka, Japan

[21] Appl. No.: 615,453

[22] Filed: Nov. 19, 1990

[30] Foreign Application Priority Data

Nov. 17, 1989 [JP] Japan ..... 1-300452

[51] Int. Cl.[5] ..... F04C 18/344

[52] U.S. Cl. ..... 418/178; 418/179

[58] Field of Search ..... 418/178, 179

[56] References Cited

U.S. PATENT DOCUMENTS

| | | | |
|---|---|---|---|
| Re. 29,806 | 10/1978 | Iida et al. | 418/178 |
| 3,856,635 | 12/1974 | Brown | 418/178 |
| 3,904,405 | 9/1975 | Russell et al. | 418/178 |
| 3,918,923 | 11/1975 | Inoue | 418/178 |
| 4,515,513 | 5/1985 | Hayase et al. | 418/178 |

FOREIGN PATENT DOCUMENTS

| | | | |
|---|---|---|---|
| 62-29782 | 2/1987 | Japan | 418/178 |
| 62-168989 | 7/1987 | Japan | 418/178 |

*Primary Examiner*—Richard A. Bertsch
*Assistant Examiner*—David L. Cavanaugh
*Attorney, Agent, or Firm*—Wenderoth, Lind & Ponack

[57] ABSTRACT

A rotary compressor is provided for use in an air conditioner of an automobile. This compressor includes a cylinder having a cylindrical inner wall portion composed of aluminum alloy filled into the pores of a sintered liner composed of iron series metallic fibers, or into the pores of a blister metal liner. With this arrangement, sliding abrasion between the cylindrical inner wall face and the vanes, and deformation thereof by gas compression forces and high temperatures, can be prevented.

1 Claim, 3 Drawing Sheets

ROTARY COMPRESSOR HAVING AN ALUMINUM BODY CAST AROUND A SINTERED LINER

BACKGROUND OF THE INVENTION

The present invention generally relates to a rotary compressor to be used for an air conditioner or the like for an automobile.

Generally, as shown by the fuel saving cost competition of the automobiles in recent years, the vehicles are expected to be made lighter in weight. It is strongly desired that the compressors for air conditioning of the automobiles be reduced in weight. The engine room of the automobile has become narrower and narrower because of the increased compactness of design and so on of auxiliary appliances accompanied by exhaust gas regulation and performance improvement. The compressors for automobile air conditioning are gradually being converted from the conventional reciprocating motion type into a rotary type, which may be made smaller in size.

Generally, the rotary compressor is provided in a cast iron cylinder 1 having a cylindrical inner wall face as shown in FIG. 5. A plurality of radial slits 4 are provided in a steel rotor 2 which is offset from the cylinder center. A plurality of vanes 5 of aluminum series metal are engaged in the radial slits for free sliding operation therein. The rotor 2 is sealed in a vane chamber 6 within the cylinder by a front plate and a rear plate (not shown). A suction hole 8, a suction groove 9, and a discharge hole 10 are formed in the above described cylinder 1. A discharge valve 11 and a discharge valve cap plate 12 are mounted for closing the discharge hole 10 from the outside. It is to be noted that there are provided a cylinder head 13, a suction chamber 14, and a discharge chamber 15.

In the above described construction, when the rotor 2 clamped with the shaft 3 is rotated, the vanes 5 engaged with the rotor 2 are caused to slide due to back pressure and centrifugal force at the rear end portions thereof, and due to contact of the tip end portions thereof being depressed against the cylindrical inner wall face of the cylinder 1. In a volume increasing step of the vane chamber 6, a low temperature, low pressure refrigerant gas is caused to flow into the vane chamber 6 from the suction hole 8 and the suction groove 9 upon rotation of the rotor 2. In a volume reducing step, the refrigerant gas is compressed to a high temperature and high pressure. When the pressure rises to the discharge pressure, the discharge valve 11 opens, and the refrigerant gas flows out from the discharge hole 10 into the discharge chamber 15.

In such construction as described hereinabove, the compressor is very heavy, because the cylinder 1, the rotor 2 and the shaft 3 are made of an iron series metal. The reciprocating type compressors are mostly made of aluminum series metal. The rotary type of compressor is not superior in terms of weight. This is because, when the vanes of the aluminum series metal slide in contact with the cylindrical inner wall face of the cylinder and the radial slits of the rotor, abrasion is likely to be caused. For example, when the cylinder or the rotor is made of an aluminum series metal, abnormal abrasion or sintering is likely to be caused by the contact during the sliding operation, which reduces the durability and reliability. In order to prevent deformation due to the compression forces and high temperatures of the refrigerant gas, the cylinder and the rotor must be formed of materials with high strength. Thus, it is difficult to reduce the weight of the rotary compressor.

SUMMARY OF THE INVENTION

Accordingly, the present invention has been developed with a view to substantially eliminating the above discussed drawbacks inherent in the prior art, and has for its essential object to provide an improved rotary compressor.

Another important object of the present invention is to provide an improved rotary compressor of the type referred to above, for which the weight of the cylinder is reduced, and for which the durability, reliability and performance are superior.

In accomplishing these and other objects, a first embodiment of the rotary compressor of the present invention is a rotary compressor which comprises a cylinder having a cylindrical inner wall face, a rotor which is offset from the cylinder center and is disposed within the above described cylinder, a side plate which has a plurality of vanes that are engaged for free sliding operation within a plurality of radial slits in the above described rotor and seals the rotor in a vane chamber formed of the above described cylinder. The compressor is characterized in that the cylindrical inner wall portion of the above described cylinder is composed of a sintered liner that has the external periphery portion thereof cast wrapped, and an aluminum alloy filled into the air holes of the sintered liner of iron series metallic fibers.

Also, a second invention is a rotary compressor where the cylindrical inner wall portion of the cylinder is composed of a cylinder with the external peripheral portion being cast wrapped, and with the aluminum alloy being filled into the air holes of a blister metal liner.

In a first invention of the present invention by the above described construction, the aluminum alloy is filled into the air holes of the sintered liner composed of iron series metallic fibers disposed in the cylindrical inner wall portion of the cylinder. Also, the external peripheral portion of the liner is cast wrapped, so that the weight of the cylinder may be reduced, and the abrasion resistance between the vanes of the aluminum series metal sliding in contact with the cylindrical inner wall face of the cylinder and the iron series metallic fibers of the sintered liner is good. This allows for a reduction in the sliding abrasion of the cylinder inner wall face or the vanes. The aluminum alloy is filled into the air holes of the sintered liner, and the external peripheral portion thereof is cast wrapped, so that a sufficient splicing strength is obtained, deformation of the cylinder by repeated loading of gas pressure and heat is reduced, and leaking is prevented. This improves the durability and reliability, and allows for weight reduction without any reduction in the efficiency.

In the second invention, the aluminum alloy is filled into the air holes of the blister metal liner disposed in the cylindrical inner wall portion of the cylinder, so that the hard intermetallic compound layer is formed on the boundary between the blister metal and the aluminum alloy so as to provide sufficient splicing strength, and superior abrasion resistance. In this manner, the durability, reliability and efficiency are improved, and the compressor can be made lighter in weight.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
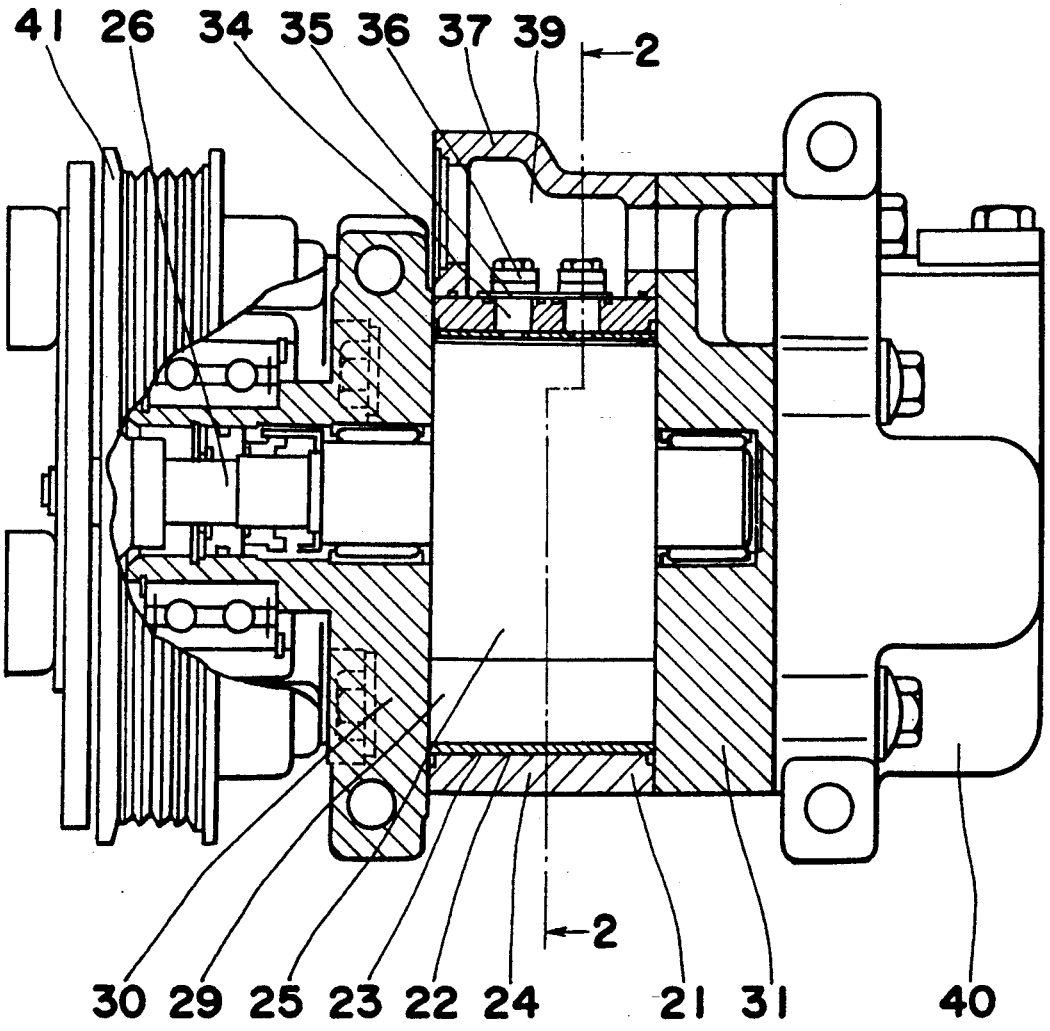
FIG. 1 is a longitudinal sectional view of a rotary compressor in a first embodiment of the present invention.

Before the description of the present invention proceeds, it is to be noted that like parts are designated by like reference numerals throughout the accompanying drawings.

Figure 2:
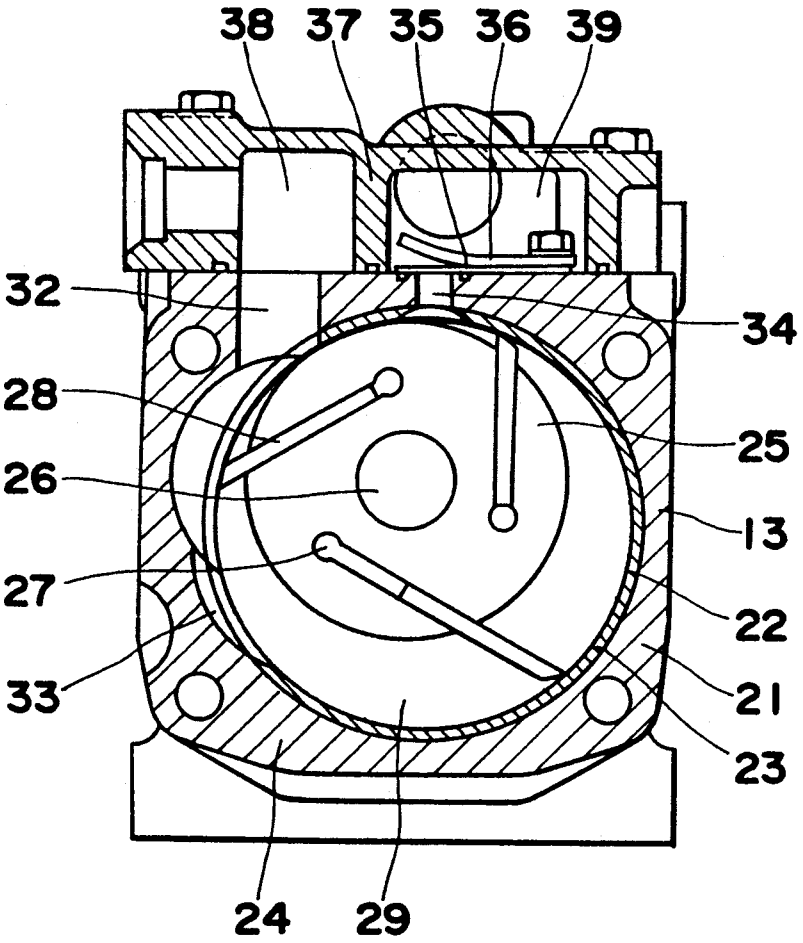
FIG. 2 is a front sectional view taken along line 2—2 of FIG. 1.

Referring now to the drawings, there is shown in FIG. 1 and FIG. 2, a rotary compressor according to a first embodiment of the present invention, which includes a cylinder 21 having a cylindrical inner wall face. The cylindrical inner wall portion 22 of the inner wall face is composed of a sintered liner 23 composed of metallic fibers of cast iron, and an aluminum alloy 24 filled into the air holes (or pores) of the above described sintered liner 23 and cast wrapped in the external peripheral portion thereof. The rotary compressor further includes a steel rotor 25 having an inner wall face, a shaft 26 clamped with the above described rotor 25 so as to drive the rotor 25, a plurality of radial slits 27 provided in the above described rotor 25, a plurality of aluminum alloy vanes 28 freely slidable in the above described radial slits 27, a vane chamber 29 defined by the cylinder 21, the rotor 25 and the vanes 28 and closed by a front side plate 30 and a rear side plate 31. These side plates are made of aluminum series metal and are secured on opposing faces of the cylinder 21. A suction hole 32, a suction groove 33 and a discharge hole 34 are formed in the cylinder 21. A discharge valve 35 and a discharge valve cap plate 36 are provided on the upper portion of the cylinder 21 at a discharge end of the discharge hole 34, so as to open and close the discharge hole 34. A cylinder head 37 is mounted on the top portion of the cylinder 21 and includes a suction chamber 38, and a discharge chamber 39 separated from the suction chamber. A rear cover 40 and an electromagnetic clutch 41 are also provided on opposing ends of the compressor, as shown in FIG. 1.

In a rotary compressor of the above described construction, when the rotor 25 is rotated, the vanes 28 are caused to slide due to the back pressure and the centrifugal force incident upon the rear end portions of the vanes, and due to the tip end portions of the vanes being depressed against the cylindrical inner wall face of the cylinder 21. As stated previously, the cylinder inner wall portion 22 of the cylinder 21 is composed of a sintered liner 23. This sintered liner 23 is formed by a sintered member of cast iron metallic fibers having a size of 60μm × 1mm. and by the aluminum alloy 24 filled into the air holes of the sintered liner 23. When the porosity of the sintered liner 23 is 10% or lower, the aluminum alloy 24 is not sufficiently filled into the air holes so as to cause gaps, so that the adherence property between the sintered liner 23 and the aluminum alloy 24 becomes insufficient, and the splicing strength becomes weaker, thus causing leakage. When the porosity is 60% or more, although the aluminum alloy 24 can be sufficiently filled into the air holes, the ratio of the aluminum alloy becomes large, so that sliding abrasion is likely to be caused between the aluminum alloy vanes 28 and the cylindrical wall face of the cylinder 21 when the tip ends of the vanes are depressed against the cylinder wall. Therefore, the porosity of the sintered liner 23 is optimum in the range 15 through 50%. In this range, the aluminum alloy can be sufficiently filled into the air holes so as to ensure sufficient splicing strength, and so that the abrasion resistance between the sintered liner 23 and the vanes 28 is increased. Thus, the weight of the cylinder may be reduced without the durability, reliability and efficiency being reduced relative to the conventional compressors.

Figure 3:
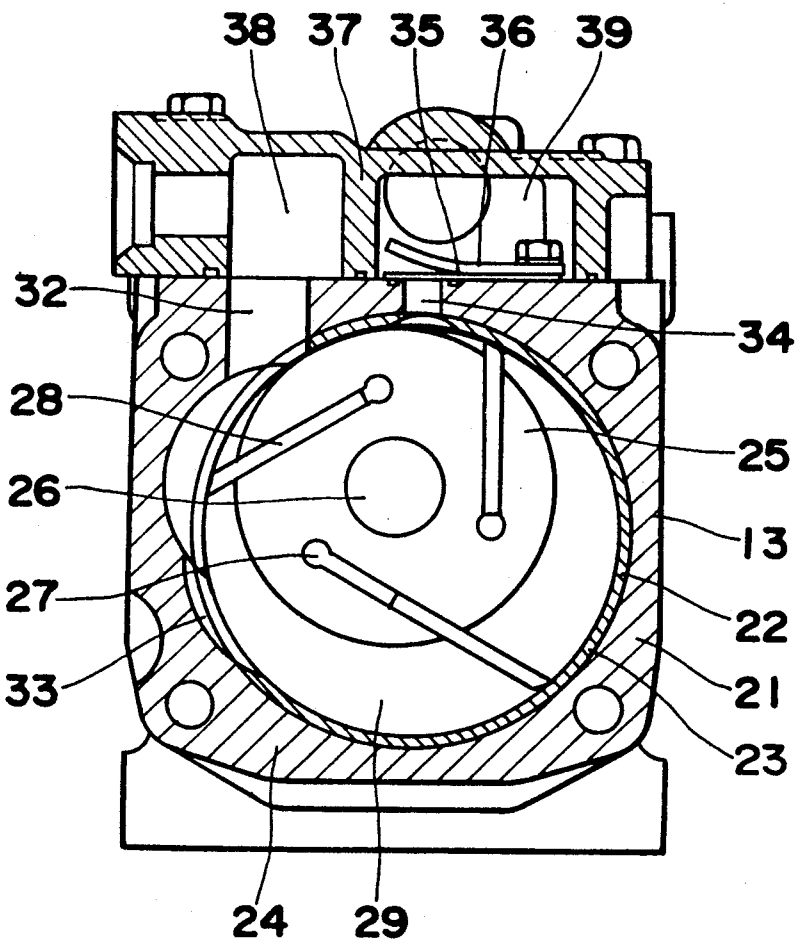
FIG. 3 is a front sectional view of a second embodiment of the present invention.
Figure 4:
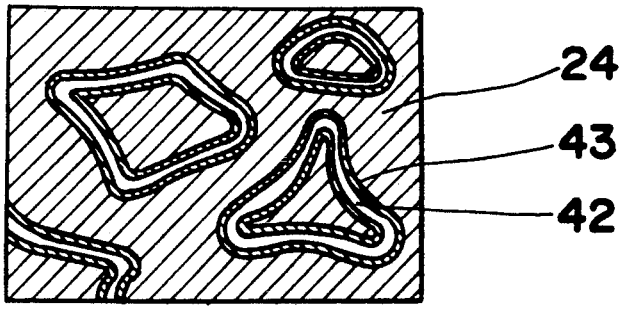
FIG. 4 is a view illustrating one example of the metallic organization of a cylindrical inner wall portion of the cylinder of FIG. 3.
Figure 5:
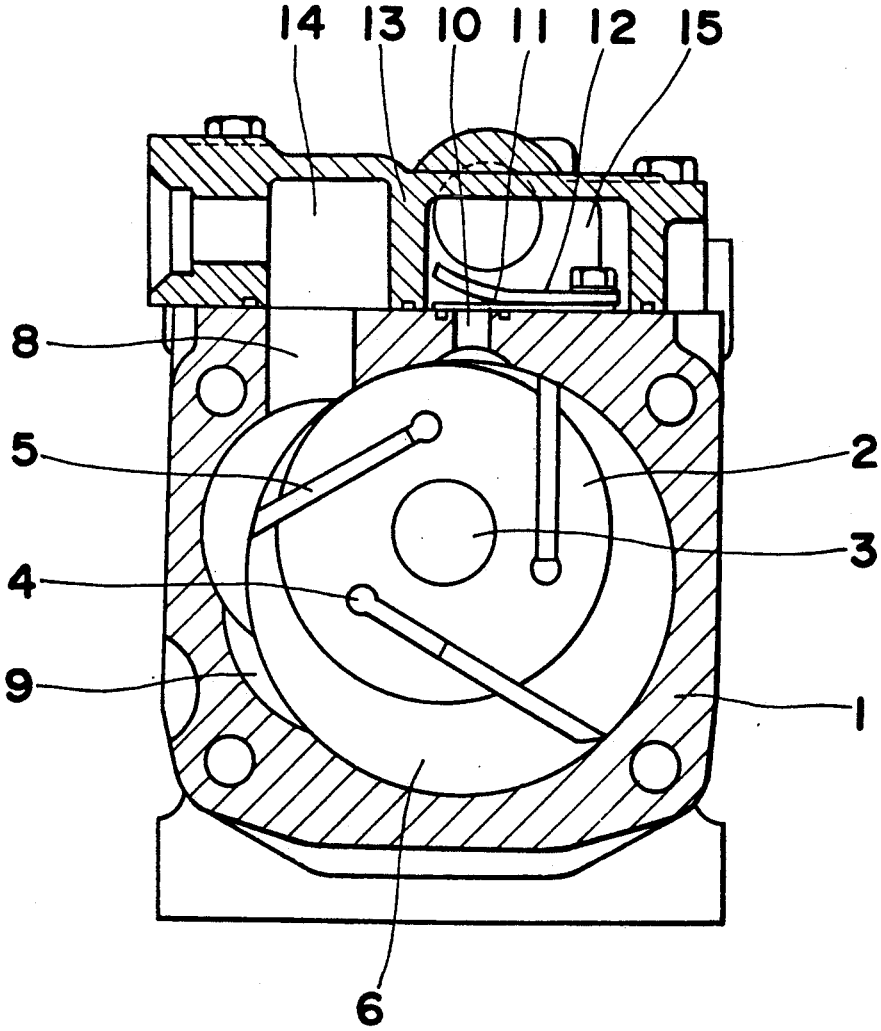
Fig. 5 PRIOR ART
FIG. 5 is a front sectional view of a conventional rotary compressor.

A second embodiment of the present invention will be described hereinafter. Referring to FIG. 3, the cylindrical inner wall portion 22 of the cylinder 21 is composed of a blister metal liner 42 made of nickel or nickel chrome, and an aluminum alloy 24 filled by a molten bath forging method into the air holes of the blister metal liner 42. As shown in FIG. 4, an intermetallic compound layer 43 of hard nickel or nickel chrome and aluminum is formed on the boundary layer between the blister metal and the aluminum alloy, with the external peripheral portion of the blister metal liner 42 being cast wrapped with the aluminum alloy 24. Therefore, the splicing strength between the blister metal liner 42 and the aluminum alloy 24 is increased so as to prevent deformation caused by gas compressive forces and high temperatures, and also to improve the abrasion resistance of the cylindrical inner wall face of the cylinder 21, so that the sliding abrasion against the aluminum alloy vanes 28 during sliding of the tip ends thereof against the cylindrical inner wall face may be reduced.

A porosity of 50 through 90% is optimum for the blister metal liner 42. When the porosity becomes 50% or lower, the density of the hard intermetallic compound layer 43 becomes larger so as to abnormally wear out the aluminum alloy vanes 28. On the other hand, when the porosity becomes 90% or more, the density of the intermetallic compound layer 43 is lowered so as to undesirably decrease the strength of the cylinder 21.

As described hereinabove, the aluminum alloy 24 is filled into the air holes of the blister metal liner 42 so as to reduce the weight without the durability, reliability and efficiency being reduced.

Although the inner wall face of the cylinder is made cylindrical in the present embodiment, the same effect is obtained even when it is made approximately oval in shape.

As is clear from the foregoing description, in the present invention, the cylindrical inner wall portion of the cylinder is composed of an aluminum alloy filled into the air holes of a sintered liner composed of iron series metallic fibers, or into the air holes of a blister metal liner. Sliding abrasion between the cylindrical inner wall face and the vanes, and deformation by gas compression forces and high temperatures, may be prevented by the provision of the cylinder with the aluminum alloy being cast wrapped on the external peripheral portion. The weight of the cylinder may be reduced without any damage to the durability, reliability and efficiency, with an effect that it may be manufactured for lower prices.

Although the present invention has been fully described by way of example with reference to the accompanying drawings, it is to be noted here that various changes and modifications will be apparent to those skilled in the art. Therefore, unless such changes and modifications otherwise depart from the scope of the present invention, they should be construed as included therein.

What is claimed is:

1. A rotary compressor comprising:

a cylinder having a cylindrical inner wall;

a rotor having a central axis and being mounted in said cylinder with said central axis offset from a center of said cylinder, said rotor having a plurality of slits formed therein;

side plates mounted at opposing ends, respectively, of said cylinder to seal said rotor in said cylinder and form a vane chamber;

a plurality of vanes slidably mounted in said slits of said rotor; and wherein said cylindrical inner wa of said cylinder is defined by a porous sintered liner with an exterior peripheral portion thereof being cast wrapped, said sintered liner having a porosity in the range of 15 through 50 percent and being formed of iron series metallic fibers with aluminum alloy filled into the pores thereof.

* * * * *